United States Patent [19]

Suzuki et al.

[11] 4,200,665

[45] Apr. 29, 1980

[54] METHOD FOR CONTROLLING THE TONER CONCENTRATION OF A DEVELOPER USED IN A DRY TYPE DEVELOPING SYSTEM

[76] Inventors: Koichi Suzuki; Shigeru Suzuki; Minoru Suzuki, all of Yokohama, Japan

[21] Appl. No.: 901,784

[22] Filed: May 1, 1978

Related U.S. Application Data

[60] Division of Ser. No. 771,732, Feb. 24, 1977, Pat. No. 4,112,867, which is a continuation of Ser. No. 587,660, Jun. 17, 1975, abandoned.

[30] Foreign Application Priority Data

Jun. 18, 1974 [JP] Japan ..... 49-69335
Jun. 19, 1974 [JP] Japan ..... 49-69854

[51] Int. Cl.[2] ..... G03G 13/09
[52] U.S. Cl. ..... 430/30; 118/658; 355/14 D; 430/122
[58] Field of Search ..... 427/8, 18; 118/7, 9, 118/657, 658, 646; 355/14; 222/DIG. 1

[56] References Cited

U.S. PATENT DOCUMENTS

| | | | |
|---|---|---|---|
| 3,152,924 | 10/1964 | Wanielista et al. | 427/21 |
| 3,802,381 | 4/1974 | O'Neill et al. | 118/7 |
| 3,892,672 | 7/1975 | Gawron | 118/7 |
| 3,893,408 | 7/1975 | Lamel | 118/7 |
| 3,932,034 | 1/1976 | Takahashi | 355/300 |

*Primary Examiner*—Michael F. Esposito
*Assistant Examiner*—Stuart D. Frenkel

[57] ABSTRACT

A method and an apparatus for controlling the toner concentration of a dry developer, including a magnetic carrier and a non-magnetic toner, used in a magnetic brush developing system. The system includes an inherent magnetic means and an inherent circulation path through a portion of which a steady stream of the developer is established during its operation. A device such as a Hall element is set at a position near the steady stream portion of the developer and in the atmosphere for detecting the magnitude of a leakage magnetic flux from the portion which is emanated from the magnetic means, to determine the value of toner concentration of the developer in the system through analyzing. Thereupon, a supply of toner to the system is automatically controlled based on the determined value.

5 Claims, 5 Drawing Figures

METHOD FOR CONTROLLING THE TONER CONCENTRATION OF A DEVELOPER USED IN A DRY TYPE DEVELOPING SYSTEM

This is a division of application Ser. No. 771,732 filed Feb. 24, 1977, now U.S. Pat. No. 4,112,867, which is a cont. of application Ser. No. 587,660, June 17, 1975, now abandoned.

BACKGROUND OF THE INVENTION

The invention relates to a method and an apparatus for controlling the toner concentration of a dry developer, including a magnetic carrier and a non-magnetic toner, used in a dry type developing system.

In a dry type developing system for example, a magnetic brush developing system, the developer generally comprises a mixture of magnetic carrier and non-magnetic toner, which mixture is magnetically maintained for supply to an electrostatic latent image for converting it into a visual image. When the developer is supplied to the latent image, charged toner particles, which adhere to carrier particles are attracted to the latent image by electrostatic interaction while the carrier remains attached to the developer retaining member under the influence of a magnetic force, so that after repeated developing process, only the toner component of the developer will be gradually reduced in quantity.

On the other hand, when converting an electrostatic latent image into a visual image by means of the magnetic brush developing system, it is known that the optimum toner concentration in the developer ranges from 3 to 5% by weight of the toner. Above 5%, the toner may be attracted to non-image areas, thus causing so-called back smearing in the visual image, while below 3%, the optical density of the visual image is reduced, resulting in a poor contrast. Therefore, it is necessary to maintain the toner concentration of the developer within a proper range in order to assure an optimum visual image.

In one technique of controlling the toner concentration, a change in the amount of reflected light from the developer, as the proportion of the toner and carrier in the developer changes, is utilized by irradiating the developer with light and determining the amount of reflected light therefrom to sense the toner concentration, thereby replenishing the toner so as to maintain a constant toner concentration. However, the described technique involves difficulties in that the light source and the light receiving element which are used for the purpose of photometric determination are liable to be soiled by the toner to result in varying photometric parameters and that a small difference in the reflectivity between the carrier and the toner results in an unsatisfactory sensing accuracy.

An alternative method is also known in which the toner is electrostatically attracted to the surface of an electrode plate to which a fixed voltage of the opposite polarity to that of the toner is applied, or to the surface of a dielectric member which is charged by an electric charge of the opposite polarity to that of the toner, followed by irradiation of the surface with light, and determining a change in the amount of light which has transmitted through or which is reflected from the surface to thereby detect the amount of toner attracted and hence the toner concentration in the developer. When this method is employed, the toner which is attracted to the surface must be wiped away each time the toner concentration is determined. This causes difficulty in detecting the toner concentration on a continuous basis and the detection accuracy of this method is susceptible to humidity.

A further alternative is to utilize a change in the apparent magnetic permeability of the developer as the proportion of the magnetic carrier and the non-magnetic toner in the developer varies. Thus, the developer is placed inside a coil to sense a change in the inductance of the coil, which is then converted into a voltage or the like, thereby determining the proportion of the carrier and toner in the developer. However, the device which is required to perform such a determination tends to be expensive. In addition, separate circulation path must be provided for the purpose of sampling independently from the inherent circulation path which is used for the purpose of developing, thus resulting in a complex overall system.

SUMMARY OF THE INVENTION

It is an object of the invention to provide a method and an apparatus for controlling toner concentration in a dry type developing system which overcomes above disadvantages and which is simple in structure and capable of detecting the toner concentration efficiently and continuously with a high detection accuracy.

DETAILED DESCRIPTION OF EMBODIMENT

Figure 1:
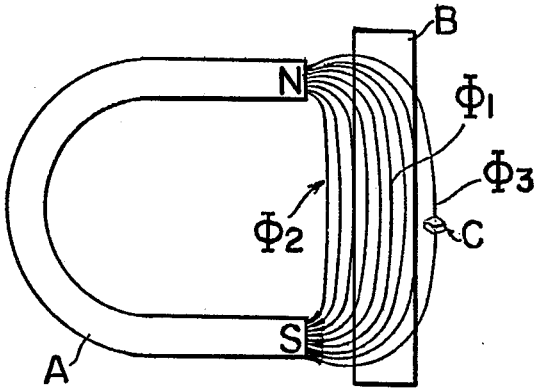
FIG. 1 is a schematic view illustrating the concept of the present invention.

FIG. 1 shows that when a permanent magnet A and a magnetizable body B are disposed in a spaced relationship in the atmosphere to form a magnetic path, the magnetic flux which emanates from the N-pole to the S-pole of the magnet A will essentially comprise a main flux $\Phi 1$ which passes through the interior of the magnetizable body B, a first leakage flux $\Phi 2$ which does not pass through the body B, and a second leakage flux $\Phi 3$ which follows a leakage path after passing through the body B. All of the fluxes $\Phi 1$, $\Phi 2$ and $\Phi 3$ depends on the magnetic reluctance of the magnetizable body B which in turn depends on the magnetic permeability and the configuration thereof.

Thus, by replacing the magnetizable body B by a plurality of magnetizable bodies B1, B2 . . . Bn (not shown) having the same configuration therewith in a sequential manner and determining the respective leakage flux $\Phi 3$ at a given position, for example, in a region C, it is possible to determine the ratio of the magnetic permeability of the magnetizable bodies B1, B2 . . . Bn relative to that of the magnetizable body B. Generally, there is not a significant difference in the magnetic reluctance between a magnetizable body and the atmosphere, so that the leakage flux $\Phi 3$ will have a relatively large magnitude, which is advantageous in facilitating its determination. The magnetic permeability of a developer used in a dry type developing process, for example, the magnetic developing process is determined by the proportion of a magnetic carrier relative to that of non-magnetic toner, so that by regarding the magnetizable bodies B, B1, B2 . . . Bn having the same configuration as masses of the developer, it is possible to determine the proportions of the carrier and toner in the developer or the relative value of the toner concentration in the developer, by determining the respective leakage fluxes Φ3.

Figure 2:
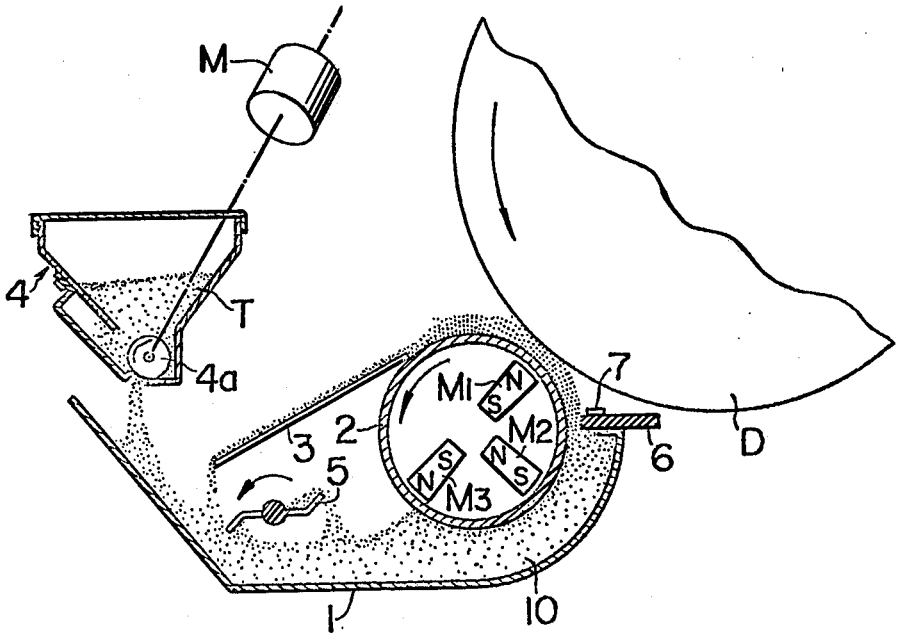
FIG. 2 is a front view of the apparatus constructed in accordance with one embodiment of the invention.

FIG. 2 shows the essential part of the magnetic brush developing apparatus which is constructed in accordance with one embodiment of the invention. The purpose of the apparatus is to convert an electrostatic latent image formed on a photosensitive drum D into a visual image. Specifically, the apparatus comprises a container 1 for containing a supply of developer 10, a plurality of magnets M1, M2 and M3 which are disposed at fixed positions relative to the container 1, a rotatable sleeve 2 of non-magnetic material which surrounds the magnets, a blade 3 for scraping the developer from the surface of the rotary sleeve 2 after its contribution to the developing process, a hopper 4 for retaining a supply of toner T, a stirring member 5, a doctor blade 6 of non-magnetic material, a magnetic detector 7, and a drive motor M.

A developing process by the described magnetic developing system proceeds as follows: The magnets M1, M2 and M3 which are fixed in position establish a stationary magnetic field in space which causes a developer 10 to be attracted to the peripheral surface of the rotary sleeve 2, thereby forming a magnetic brush thereon. As the rotary sleeve 2 rotates in the direction indicated by an arrow in FIG. 2, the magnetic brush of a given height is formed by the doctor blade 6 and is brought into contact with the successive surface regions of the photosensitive drum D which rotates in the same direction, whereby, the toner contained in the developer is attracted by the electric charge which forms an electrostatic latent image, thereby converting the latent image into a visual image on the drum D. As the sleeve 2 further rotates, the developer is scraped off the surface of the rotary sleeve 2 by the blade 3, whereupon it slides down the inclined surface of the blade 3 to the vicinity of the stirring member 5. The stirring member 5 is rotated in the direction indicated by an arrow to urge the developer toward the rotary sleeve 2.

The flux detector 7 is fixedly mounted on top of the doctor blade 6 and in a fixed position relative to the stationary magnets M1, M2 and M3. Because the developer which forms the magnetic brush is shaped to a given configuration on the peripheral surface of the rotary sleeve 2 by means of the doctor blade 6, the relative position of the flux detector 7 with respect to the magnetic brush formed on the rotary sleeve 2 is fixed, so that the determination of the leakage flux from the magnets M1, M2 and M3 which passes through the brush with the aid of the detector 7 permits the toner concentration in the developer supplied to the electrostatic latent image to be sensed. Such determination can be based on calibration data which is established by measuring the leakage flux against a variety of developers of known toner concentration.

Figure 3:
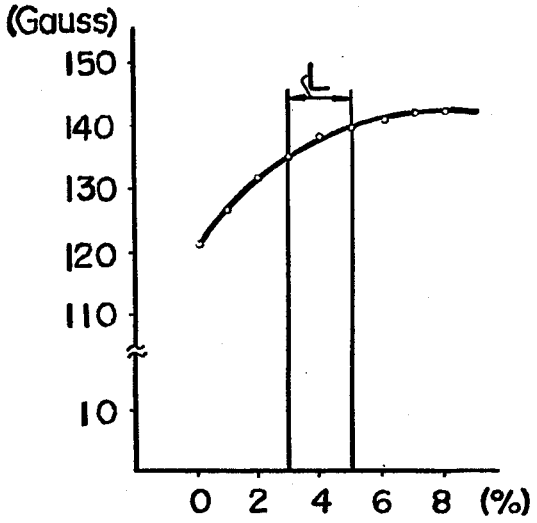
FIG. 3 graphically shows one exemplary characteristic representing the relationship between the toner concentration and the leakage flux in the embodiment shown in FIG. 2.

The curve shown in FIG. 3 illustrates one experimental result representing the relationship between the leakage flux and the toner concentration in the developer. The abscissa represents percentage by weight of the toner in the developer while the ordinate represents the leakage flux as detected by the detector 7 in the units of Gauss. In the graph, the letter L indicates the optimum range of toner concentration.

Figure 4:
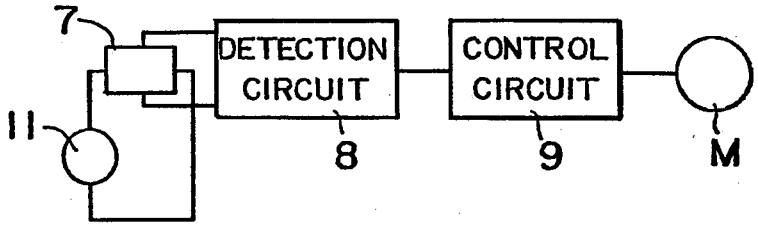
FIG. 4 is a block diagram of a toner concentration control unit which is used in the embodiment shown in FIG. 2.

As indicated in FIG. 4, a flux detector device comprises the flux detector 7 and a detection circuit 8 which feeds a control circuit 9. The control circuit 9 is adapted to control the energization of the drive motor M shown in FIG. 2. When the drive motor M is energized, a rotary valve 4a located within the hopper 4 is rotated to supply a quantity of toner contained in the hopper 4 into the container 1 for the purpose of replenishment. The control circuit 9, the drive motor M and the hopper 4 constitute together a toner replenishing device.

The flux detector 7 comprises a Hall element which is supplied with a control current from a stabilized d.c. current source 11 in a direction perpendicular to the magnetic flux. The magnitude of the leakage flux at the location of the detector 7 can be detected by the detection circuit 8 as a Hall voltage $V_H$ which is developed across the detector 7 in a direction perpendicular to that of both the magnetic flux and the control current.

Figure 5:
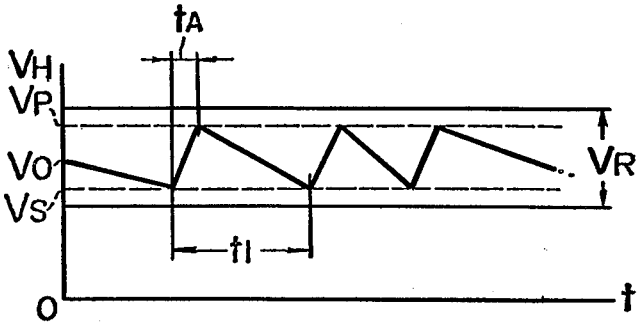
FIG. 5 graphically shows a variation in the output of a magnetic flux detector as the toner content in the developer varies.

As illustrated in FIG. 5, the output of the detector 7 varies within a range $V_R$ which includes a Hall voltage $V_P$ corresponding to the upper limit of the optimum range of toner concentration in the developer, and another Hall voltage $V_S$ corresponding to the lower limit of the range.

Under the initial condition, the toner concentration in the developer is adjusted to a given value, for example, 4%, which corresponds to a Hall voltage $V_O$, as detected by the detection circuit associated with the detector 7. As the developing process proceeds and the toner in the developer is consumed, there results a relative increase in the concentration of the magnetic carrier to increase the magnetic permeability, whereby the leakage flux decreases to cause a reduction in the Hall voltage $V_H$ which is detected by the detection circuit 9. When the Hall voltage $V_H$ decreases below the Hall voltage $V_S$, the output of the detection circuit 8 causes the control circuit 9 to energize the drive motor M. Thereupon the rotary valve 4a in the hopper 4 rotates to replenish the toner from the hopper 4 into the container 1. The replenished toner is uniformly stirred in the developer by means of the stirring member 5 and urged toward the rotary sleeve 2. As a result, the toner concentration in the magnetic brush increases to decrease the magnetic permeability of the developer which forms a magnetic brush, thus increasing the leakage flux and hence the Hall voltage $V_H$ as detected by the detection circuit 8. As the toner concentration in the developer increases and the Hall voltage $V_H$ rises above the Hall voltage $V_P$, the output of the detection circuit 8 causes the control circuit 9 to deenergize the drive motor M. This process is repeated during the subsequent developing process. The interval $t_1$ between subsequent replenishment of the toner varies with the kind of originals to be copied, while the period $t_A$ during which the replenishment is performed remains substantially constant. However, it should be understood that the period of replenishment can be changed by the suitable design of the replenishing device. The level $V_P$ inherently depends on the hysterisis characteristic of the detection circuit 8. In this manner, the toner concentration in the developer can be maintained in the optimum range.

It should be understood that the leakage flux can be detected by other means than the Hall element, such as a magnetic reluctance element, a magnetically sensitive diode or the like.

What is claimed is:

1. A method of controlling the dry non-magnetic toner concentration of a developer which comprises a magnetic carrier and the toner and which is used in a copying device which includes a drum having an electrostatic latent image thereon which is contacted by the developer, comprising disposing a magnet adjacent the drum to establish a magnetic field for forming a continuous magnetically attracted brush of the developer and to produce a leakage flux in the vicinity of the developer and the drum, advancing moving support means through a portion of the developer and over the magnetic field so as to pick up the developer due to the action of the magnetic field on the support means with the developer forming the continuous magnetically attracted brush of the developer, shaping the magnetic brush by doctoring the brush to a predetermined height, directing the support means adjacent the drum so as to engage the picked up developer with the surface of the drum, sensing the amount of the magnetic leakage flux from said magnet which passes through the magnetically attracted brush of the developer as it is moved by the support means before it contacts the drum so as to determine a toner concentration which is proportional to the sensed leakage flux, and varying the toner concentration in the developer in accordance with the sensed leakage flux.

2. A method according to claim 1, wherein the support means comprises at least one rotatable sleeve which includes a portion which dips into the developer and a portion which moves over the magnetic field.

3. A method according to claim 1, including doctoring the surface of the magnetically attracted brush which is picked up by the support means on the way to its delivery to the surface of said drum.

4. A method according to claim 3, wherein the leakage flux is sensed over the surface of the magnetically attracted brush which is carried by the support means and after the doctoring of the magnetically attracted brush.

5. A method according to claim 1, wherein the developer is recirculated and including supplying additional developer, and varying the toner concentration of the additionally supplied toner in accordance with the leakage flux which is sensed.

* * * * *